US011149393B2

(12) United States Patent
Abeles

(10) Patent No.: US 11,149,393 B2
(45) Date of Patent: Oct. 19, 2021

(54) BEACH EROSION INHIBITOR

(71) Applicant: Gary E. Abeles, Verona, NJ (US)

(72) Inventor: Gary E. Abeles, Verona, NJ (US)

( * ) Notice: Subject to any disclaimer, the term of this patent is extended or adjusted under 35 U.S.C. 154(b) by 0 days.

(21) Appl. No.: 17/179,048

(22) Filed: Feb. 18, 2021

(65) Prior Publication Data

US 2021/0172137 A1 Jun. 10, 2021

Related U.S. Application Data

(63) Continuation-in-part of application No. 16/904,047, filed on Jun. 17, 2020, now Pat. No. 10,954,641, which is a continuation-in-part of application No. 16/480,476, filed as application No. PCT/US2018/012781 on Jan. 8, 2018, now Pat. No. 10,718,095.

(60) Provisional application No. 62/451,394, filed on Jan. 27, 2017.

(51) Int. Cl.

| | |
|---|---|
| ***E02B 3/04*** | (2006.01) |
| ***E02B 3/10*** | (2006.01) |
| ***E02B 3/06*** | (2006.01) |

(52) U.S. Cl.

CPC ..... *E02B 3/108* (2013.01); *E02B 3/06* (2013.01)

(58) Field of Classification Search

CPC ..... E02B 3/04; E02B 3/12; E02B 3/06; E02B 3/108

USPC ..... 405/15, 16, 302.4, 302.6

See application file for complete search history.

(56) References Cited

U.S. PATENT DOCUMENTS

| | | | |
|---|---|---|---|
| 2,474,786 | A | 6/1949 | Humphrey |
| 3,280,569 | A | 10/1966 | Wosenitz |
| 3,386,250 | A | 6/1968 | Susumu |
| 3,653,216 | A | 4/1972 | Stickler, Jr. |
| 3,844,125 | A | 10/1974 | Williams, Sr. |
| 4,129,006 | A | 12/1978 | Payne |
| 4,367,978 | A | 1/1983 | Schaaf et al. |

(Continued)

FOREIGN PATENT DOCUMENTS

| | | |
|---|---|---|
| CN | 202280039 U | 6/2012 |
| WO | 2006031525 A2 | 3/2006 |

OTHER PUBLICATIONS

Notice of Allowance for U.S. Appl. No. 16/904,047, dated Nov. 25, 2020, 10 Pages.

(Continued)

*Primary Examiner* — Benjamin F Fiorello

(74) *Attorney, Agent, or Firm* — Maine Cernota & Rardin

(57) ABSTRACT

A system for impeding shore erosion includes a sea-facing barrier wall penetrated by large holes that allow water with entrained sand to enter the apparatus. Smaller holes provided in a rear wall allow the water to drain into an underlying reservoir after the entrained sand has settled. An extension can be abutted to a top of the barrier wall to enhance sand collection during a storm. Water that flows over the barrier wall is caused to flow over a top of the extension, whereby water with entrained sand falls through openings in the extension top. Sand collected by the extension remains on the shore when the extension is removed. The apparatus can include plywood, metal, or plastic. Embodiments can be disassembled and/or folded for transport and storage. Internal reinforcing partition walls can extend between the barrier and rear walls. The apparatus can be further anchored by stakes.

20 Claims, 14 Drawing Sheets

(56) References Cited

U.S. PATENT DOCUMENTS

| | | | | |
|---|---|---|---|---|
| 4,479,740 | A | 10/1984 | Schaaf | |
| 4,711,598 | A | 12/1987 | Schaaf | |
| 4,818,141 | A | 4/1989 | Rauch | |
| 4,978,247 | A | 12/1990 | Lenson | |
| 5,102,257 | A | 4/1992 | Creter | |
| 5,176,468 | A | 1/1993 | Poole | |
| 5,405,217 | A | 4/1995 | Dias | |
| 5,564,369 | A | 10/1996 | Barber | |
| 5,655,851 | A | 8/1997 | Chor | |
| D417,314 | S | 11/1999 | Smith, Jr. | |
| 6,565,283 | B1 | 5/2003 | Hall | |
| 6,616,383 | B2 | 9/2003 | Janz | |
| 6,672,799 | B2 * | 1/2004 | Earl | E02B 3/04 404/6 |
| 8,226,325 | B1 | 7/2012 | Pierce, Jr. | |
| 8,585,318 | B1 | 11/2013 | Walker | |
| 8,747,023 | B1 * | 6/2014 | Walker | E02B 3/06 405/21 |
| 9,157,204 | B2 * | 10/2015 | Pierce, Jr. | E02B 3/06 |
| 10,718,095 | B2 | 7/2020 | Abeles | |
| 2006/0056913 | A1 | 3/2006 | Herzog | |
| 2006/0159518 | A1 | 7/2006 | Cravens | |
| 2006/0275081 | A1 | 12/2006 | Medina Folgado | |
| 2009/0154996 | A1 | 6/2009 | Liner | |
| 2010/0310313 | A1 | 12/2010 | Kohlenberg | |
| 2016/0348327 | A1 | 12/2016 | Martin | |
| 2017/0342673 | A1 | 11/2017 | O'Sullivan | |

OTHER PUBLICATIONS

Office Action for Chinese Patent Appl. No. 201880008696.9, dated Oct. 20, 2020, 9 Pages.

Office Action for U.S. Appl. No. 16/904,047, dated Aug. 20, 2020, 8 Pages.

International Preliminary Report on Patentability for Appl No. PCT/US2018/012781, dated Aug. 8, 2019, 8 pages.

PCT International Search Report and Written Opinion for Appl No. PCT/US2018/012781, dated Apr. 27, 2018, 12 pages.

* cited by examiner

BEACH EROSION INHIBITOR

RELATED APPLICATIONS

This application is a continuation in part of U.S. application Ser. No. 16/904,047 filed on Jun. 17, 2020. U.S. application Ser. No. 16/904,047 is a continuation in part of U.S. application Ser. No. 16/480,476, filed on Jul. 24, 2019, now U.S. Pat. No. 10,718,095. U.S. application Ser. No. 16/480,476 is a national phase application of PCT application PCT/US2018/012781, filed on Jan. 8, 2018. Application PCT/US2018/012781 claims the benefit of U.S. Provisional Application No. 62/451,394, filed Jan. 27, 2017. All of these applications are herein incorporated by reference in their entirety for all purposes.

FIELD OF THE INVENTION

The invention relates to apparatus and methods of reducing and reversing beach erosion, and more particularly to apparatus and methods for capturing and retaining entrained sand from ocean waves.

BACKGROUND OF THE INVENTION

The action of ocean waves on sandy beaches often leads to significant loss of shoreline due to beach erosion, as the waves repeatedly break onto the beach, causing sand to mix with the water and wash out to sea as the waves recede. Beach erosion is an issue of significant economic, esthetic, ecological, and practical concern, such that a considerable amount of effort and cost are expended each year in various attempts to protect and rebuild beaches.

Attempts to reduce or reverse beach erosion are generally directed to re-directing or blocking the energy of ocean waves before they reach the shoreline. One approach is to install an artificial breakwater, levee, or "groin" that blocks wave action and creates a region of low wave activity that is essentially an artificial harbor or cove. However, these structures are very large and heavy, expensive to build, and nearly impossible to remove or relocate as localized requirements evolve. Also, sand often tends to collect on one side of such a breakwater or levee, and be diminished on the other side, which may not be a desired effect.

Another approach is to submerge any of various types of barriers at or beyond the low tide level so as to partially block waves as they approach the shore and thereby reduce the energy with which the waves strike the beach. Some of these barriers include open tops or flow-through holes that encourage the sea water to pool long enough for any entrained sand to settle behind them and/or within their interiors. However, such barriers are also heavy, expensive to manufacture and install, and difficult to remove or relocate as needed.

Yet another approach is to deposit heavy chunks of concrete and/or other such materials, generally referred to as "riprap," below the waterline, which also has the effect of reducing wave energy and encouraging entrained sand to settle. While somewhat less expensive to manufacture and install than other forms of underwater barrier, riprap is virtually impossible to remove or relocate. Also, riprap can tend to become buried over time as sand is deposited, thereby reducing and eliminating its effectiveness.

The most common approach to reducing beach erosion that is implemented above the waterline is the planting of shoreline-compatible grasses that tend to stabilize the sand and protect it from wind erosion, and from the onrush of wave-driven water near the high tide mark. Such grasses can further serve to filter the ocean water as it recedes, so as to strain out and retain any sand that is entrained therein. However, shoreline-compatible grasses can be expensive, difficult, and time-consuming to establish, and grasses are not a viable solution when a sand beach is desired for recreational and/or other purposes.

What is needed, therefore, is an apparatus for impeding and/or rebuilding sand beach erosion and/or rebuilding sand beaches that is light in weight, easy and inexpensive to install, and easy to remove and relocate.

SUMMARY OF THE INVENTION

A sand-collecting apparatus that can be used to reduce sand beach erosion and/or rebuild sand beaches is disclosed that is light in weight, easy and inexpensive to install, and easy to remove and relocate. A method for employing the disclosed sand-collecting apparatus is also disclosed.

Rather than attempting to reduce or block wave energy, the disclosed sand-collecting apparatus filters and removes entrained sand from the water that flows upward across the beach after a wave has broken. The disclosed sand-collecting apparatus is configured for placement near or at the high tide level, where it is not subject to strong wave action, except during storms. Accordingly, the disclosed sand-collecting apparatus can be relatively light in weight, and is therefore less expensive to construct, easier to install, and easier to remove and/or relocate than prior art devices. As sand is accumulated by the sand-collecting apparatus over time, the sand-collecting apparatus can easily be relocated seaward, so as to build and extend the beach to any desired degree.

The disclosed sand-collecting apparatus comprises a rigid or semi-rigid, sea-facing barrier wall that is penetrated by a plurality of "large" holes. The barrier wall is inclined in a land-ward direction so that when a wave breaks at some location seaward of the barrier wall, the resulting rush of water is directed upward across the front surface of the barrier wall, causing at least some of the water to enter through the large holes into an interior of the sand-collecting apparatus behind the barrier wall.

The sand-collecting apparatus further comprises a rear wall and, in embodiments, also one or two side walls, which create a semi- or fully enclosed interior within which the water that enters through the large holes forms a pool, allowing entrained sand to settle. Small holes, which are smaller than the large holes, are provided in the rear wall and, in embodiments, in at least one side wall, so that sea water that has pooled within the interior can slowly drain out of the interior and return to the ocean after the entrained sand has settled out. In embodiments, the small holes are offset from the base of the sand-collecting apparatus so as to encourage pooling of the water before it drains through the small holes.

The sand-collecting apparatus further includes an underlying water reservoir that collects and fills with water almost immediately after the sand-collecting apparatus is placed on the shore, thereby maintaining the sand-collecting apparatus in place. The underlying reservoir extends behind the rear wall of the sand-collecting apparatus, and includes an open region that is positioned to receive water as it flows out of the sand-collecting apparatus interior through the small holes. In some embodiments the overlying elements of the sand-collecting apparatus are attachable to and detachable from the underlying water reservoir. In other embodiments, the underlying water reservoir is inseparable from the remainder of the sand-collecting apparatus.

The weight of the underlying water reservoir when filled with water enables the sand-collecting apparatus to be constructed from materials that are light in weight, and/or enables the sand-collecting apparatus to be placed further toward the water within the tidal region, i.e. where it will encounter stronger waves, with reduced concern that the sand-collecting apparatus may be displaced by the force of the waves before the weight of accumulated sand within the interior of the sand-collecting apparatus is sufficient to hold the sand-collecting apparatus in place. In embodiments, the underlying water reservoir enables the sand-collecting apparatus to resist displacement by wave action without any need to use stakes or other mechanisms to anchor the sand-collecting apparatus in place. Other embodiments include an anchoring feature, such as anchor stakes that can be driven into the sand.

In some embodiments a water release door is provided in at least one side wall of the sand-collecting apparatus or underlying reservoir that can be opened to release water that has been retained within the interior of the underlying reservoir. This feature can be useful, for example, when preparing to relocate the sand-collecting extension and underlying reservoir.

In some embodiments, the underlying water reservoir is configured for installation below the surface of the beach, so that the remainder of the sand-collecting apparatus extends from the level of the sand upward. In other embodiments, the underlying water reservoir is configured for placement onto the sand surface of the beach, and in some of these embodiments the underlying water reservoir extends in front of the barrier wall and is shaped so as to guide oncoming water up from the sand to the large holes of the barrier wall.

In embodiments, an upper end of the barrier wall is curved seaward, so that energetically flowing water that reaches the top of the barrier wall, resulting for example from large waves generated during a storm, is directed back toward the sea and does not flow over the barrier wall to the sand behind the sand-collecting apparatus. In some of these embodiments, the barrier wall extends above the rear wall, and in some of these embodiments a backstop wall extends from behind the rear wall to the barrier wall at a point above the top of the rear wall, so that an additional sand-collecting chamber is formed between the backstop wall and the rear wall. In these embodiments, the backstop wall is also penetrated by small holes, and the underlying reservoir extends beyond and behind the backstop wall, so that the open region of the underlying reservoir is positioned to receive water as it flows out of the sand-collecting apparatus interior through the small holes provided in the backstop wall.

In other embodiments, deflection seaward of energetically flowing water that reaches the top of the barrier wall is not desired, because sand that is entrained in the water will also be returned to the sea, rather than being retained on the shore. Instead, some of these embodiments include a sand-collecting extension that can be coupled to the sand-collecting apparatus and underlying water reservoir. The sand-collecting extension includes a top that is penetrated by very large holes, which in embodiments are larger than the "large" holes of the sand-collecting apparatus. When attached to the sand-collecting apparatus, the top of the sand-collecting extension extends to the upper edge of the barrier wall, so that energetically flowing water that flows over the top of the barrier wall is caused to flow across the top of the sand-collecting extension, whereupon water containing entrained sand falls through the very large holes and into an interior of the sand-collecting extension. It will be noted that the sand-collecting extension is also referred to herein simply as the "extension."

The interior of the sand-collecting extension is bounded by a rear wall of the extension and, in embodiments, by two side panels of the extension. The front of the extension is open, so that top of the sand-collecting extension can extend over a rear portion of the sand-collecting apparatus and underlying water reservoir. When the extension is attached to the sand-collecting apparatus, the rear wall of the underlying water reservoir becomes the front boundary of the extension interior.

As water and sand fall into the interior of the extension, the sand settles and separates from the water. As the level of water above the sand rises, the water is able to flow over the rear wall of the underlying reservoir and into the underlying reservoir. In embodiments a mesh or screen is provided over the rear entrance to the underlying reservoir, so as to minimize entry of sand into the underlying reservoir.

In various embodiments, the rear wall of the sand-collecting extension includes additional holes that allow excess water to escape from the interior of the extension after the underlying reservoir has been filled with water.

According to a disclosed method of use of the sand-collecting extension, a sand-collecting apparatus is located near a shoreline above the high tide level and functions during calm weather to retain entrained sand from incoming waves. When a storm approaches, the extension is temporarily attached to the sand-collecting apparatus and underlying reservoir. During the storm, energetic water together with entrained sand flows over the top of the barrier wall of the sand-collecting apparatus and falls through the very large holes into the interior of the extension. Excess water flows into the underlying reservoir until it is filled, after which additional excess water flows out through the rear wall holes of the extension. Meanwhile, sand settles and collects within the interior of the extension.

After the storm has passed, the extension is lifted away from the sand-collecting apparatus, releasing any retained water and leaving behind the sand that was collected during the storm. The newly accumulated sand can simply be left in place, or it can be distributed beyond the sand-collecting apparatus, for example using a rake.

Embodiments of the disclosed sand-collecting apparatus and extension are constructed from plywood, from metal, from a plastic such as acrylic, from fiberglass, from particle board, which may include a laminated coating or veneer, from micro-lattice, from rigid foam, from Styrofoam, from graphene, and/or from any other suitable material. Embodiments of the sand-collecting apparatus and extension can be easily disassembled and/or folded for transport and for storage at the deployed location or elsewhere.

Embodiments of the sand-collecting apparatus that require enhanced structural strength include internal partition walls that extend between and reinforce the barrier wall and rear wall. The partition walls are penetrated by additional, interior large holes, so that water mixed with entrained sand that enters through the large holes provided in the barrier wall is able to flow downward through the interior large holes to the bottom of the apparatus interior. Embodiments further include at least one support wall within the underlying water reservoir that helps to support the weight of the overlying portions of the apparatus, especially as the interior of the apparatus fills with deposited sand. The support walls are penetrated by holes, so that water is able to flow freely within the reservoir.

In some embodiments, interior support walls are, or can be, included within the interior of the sand-collecting extension so as to provide extra support to the top of the extension.

While much of the description provided herein refers to "ocean" beaches, it should be noted that the disclosed invention is equally applicable to all sandy beaches that are exposed to wave action, including beaches adjacent to seas and large lakes.

A first general aspect of the present invention is a system for reducing shore erosion. The system includes a sand-collecting apparatus that comprises a barrier wall having a top and a bottom, the barrier wall being inclined backward at an angle of at least 20 degrees from vertical, a first plurality of holes penetrating the barrier wall, an apparatus rear wall having a top and a bottom, the apparatus rear wall being located behind the barrier wall so that a chamber space is formed between and bounded by the barrier wall and the apparatus rear wall, and a second plurality of holes penetrating the apparatus rear wall, the holes of the second plurality of holes being smaller in diameter than the holes of the first plurality of holes, the first plurality of holes being configured to allow water to flow through the barrier wall and into the chamber space, and the second plurality of holes being configured to allow water to flow through the apparatus rear wall out of the chamber space.

The system further includes an underlying water reservoir located beneath the chamber space and fixed to the barrier wall and apparatus rear wall, the underlying water reservoir being configured to receive and be filled with the water that flows through the second plurality of holes out of the chamber space.

In addition, the system further includes a sand-collecting extension that includes an extension top penetrated by a third plurality of holes, and an extension rear wall extending downward from a rear edge of the extension top, a front edge of the extension top being removably fixable to the top of the barrier wall, such that water flowing over the top of the barrier wall flows across the extension top, an interior of the sand-collecting extension being in liquid communication with the underlying reservoir.

In embodiments, the sand-collecting apparatus rear wall is inclined from vertical in a forward direction, so that the top of the apparatus rear wall is in contact with a rear surface of the barrier wall.

In any of the above embodiments, a thickness of the barrier wall can be between ¼ inch and two inches.

In any of the above embodiments, at least one of the barrier wall, the apparatus rear wall, the underlying reservoir, the extension top, and the extension rear wall can be made from plywood, metal, fiberglass, particle board, microlattice, rigid foam, Styrofoam, graphene, and/or plastic.

Any of the above embodiments can further include a bottom panel extending from the bottom of the apparatus rear wall to the bottom of the barrier wall and forming a lower boundary of the chamber space.

In any of the above embodiments, the chamber space can be further bounded by at least one side wall. In some of these embodiments at least one of the side walls is penetrated by a fourth plurality of holes.

In any of the above embodiments, the sand-collecting extension can further include a pair of opposing side walls.

In any of the above embodiments, the extension rear wall can be penetrated by a fifth plurality of holes.

In any of the above embodiments, the underlying reservoir can further include a door that can be opened to release water from within the underlying reservoir. In some of these embodiments the door is located in a side panel of the sand-collecting apparatus or underlying reservoir.

In any of the above embodiments, the holes of the second plurality of holes can have diameters that are less than ¼ inch.

In any of the above embodiments, the holes of the first plurality of holes can have diameters that are between ¼ inch and 6 inches.

Any of the above embodiments can further include a plurality of anchoring stakes configured to anchor the underlying water reservoir, the sand-collecting extension, and/or the barrier wall to underlying sand.

In any of the above embodiments, the underlying water reservoir can be removably attached to the sand collecting apparatus rear wall.

In any of the above embodiments, the underlying water reservoir can include a curved front that is configured when placed on a sand surface of the shore to guide oncoming water to the barrier wall.

In any of the above embodiments, the barrier wall and apparatus rear wall can be configured so as to be pivoted about their bottoms so that they overlap with each other in a substantially flat, folded configuration.

A second general aspect of the present invention is a method for reducing erosion of a sand shore that abuts a body of water, wherein the body of water generates waves that break onto the sand shore. The method includes providing an embodiment of the first general aspect, installing the sand-collecting apparatus on the sand shore in an orientation wherein the barrier wall faces the body of water, the apparatus being installed at a location above a highest location where the waves break, but in a location where water emitted by the breaking waves will reach the apparatus. The method further includes, before the onset of a storm, locating the sand-collecting extension behind the sand-collecting apparatus, and causing the front edge of the extension top to abut the top of the barrier wall.

During the storm, as water mixed with entrained sand from breaking waves flows up the barrier wall and across the extension top, the method further includes allowing the water and entrained sand to flow through the first plurality of holes into the chamber space, and through the third plurality of holes into the interior of the sand-collecting extension, while the underlying reservoir is filled by excess water that flows through at least one of the first, second, and third plurality of holes, during the storm, allowing the entrained sand in the water to accumulate within the chamber space and within the interior of the sand-collecting extension.

Upon cessation of the storm, the method further includes removing the sand-collecting extension from the sand-collecting apparatus, whereby the sand that has settled within the interior of the sand-collecting apparatus remains on the shore behind the sand-collecting apparatus.

Embodiments further include relocating the sand-collecting apparatus after sand has been accumulated therein, the accumulated sand being left behind as added shore sand.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is an apparatus that is able to reduce sand beach erosion and/or rebuild sand beaches. The apparatus includes a sand-collecting apparatus and a sand-collecting extension, both of which are light in weight, easy and inexpensive to install, and easy to remove and relocate. A method for employing the disclosed sand-collecting apparatus is also disclosed.

Rather than attempting to reduce or block wave energy, the disclosed sand-collecting apparatus filters and removes entrained sand from the water that flows upward across the beach after a wave has broken. The disclosed sand-collecting apparatus is therefore configured for placement near or at the high tide level, where it is not subject to strong wave action. Accordingly, the disclosed sand-collecting apparatus can be relatively light in weight, and is therefore less expensive to construct, easier to install, and easier to remove and/or relocate than prior art devices. As sand is accumulated within the sand-collecting apparatus over time, the sand-collecting apparatus can easily be moved seaward, leaving the accumulated sand behind, to build and extend the beach to any desired degree.

During a storm, the collection of entrained sand can be enhanced by temporarily attaching a sand-collecting extension to the sand-collecting apparatus. The extension includes a top that extends rearward from the sand-collecting apparatus, where the top is penetrated by very large holes that cause energetic water flowing over the top of the sand-collecting apparatus to fall into an interior of the extension, wherein the entrained sand settles and is collected.

Figure 1A:
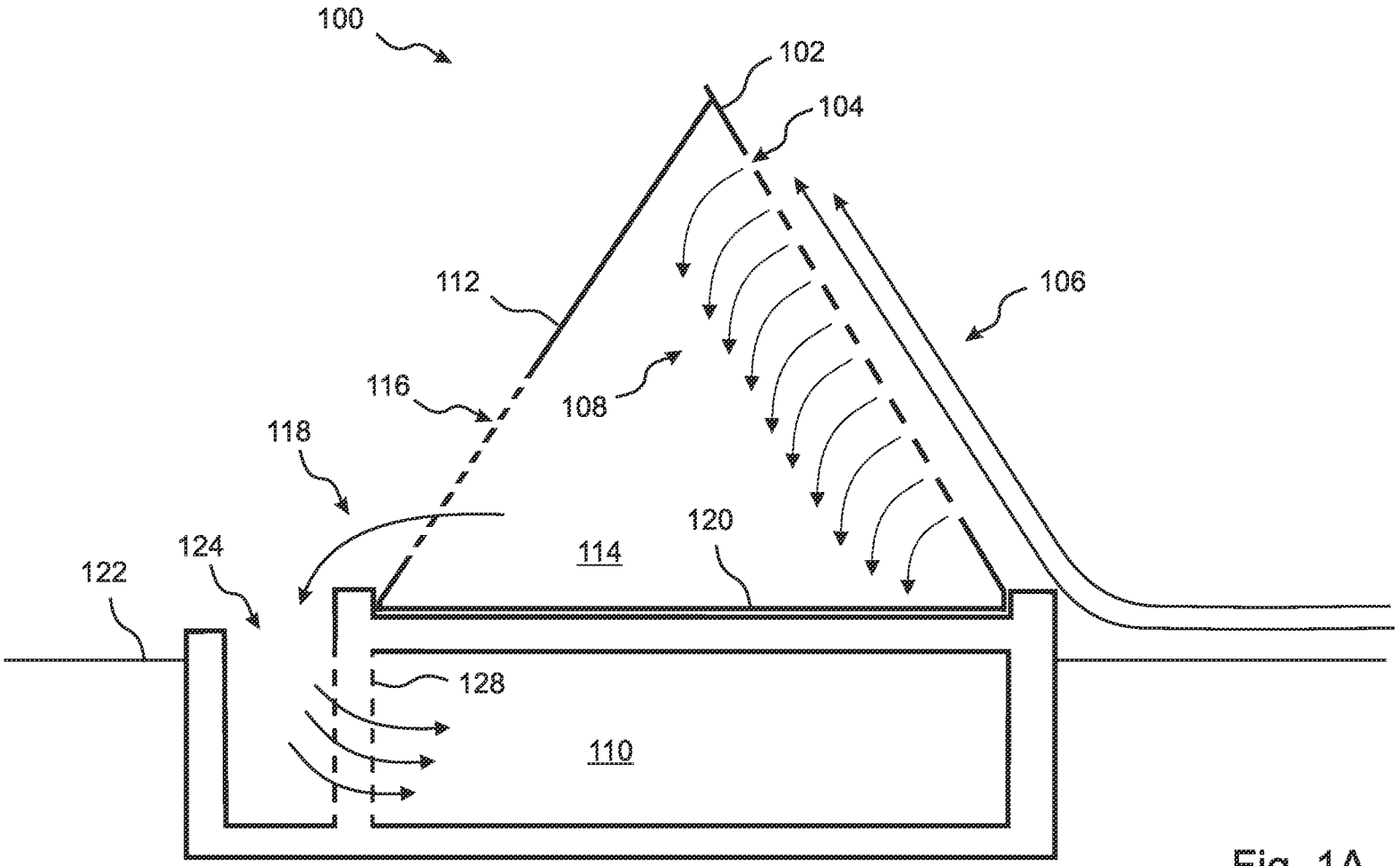
FIG. 1A is a cross-sectional view of a foldable sand-collecting apparatus according to an embodiment of the present invention that is removably attached to an underlying water reservoir configured to be buried below the sand surface of a beach, shown in a deployed configuration interacting with flowing water.

With reference to FIG. 1A, the disclosed sand-collecting apparatus 100 comprises a rigid or semi-rigid, sea-facing barrier wall 102 that is penetrated by a plurality of "large" holes 104, which are typically between one half inch and 6 inches in diameter. The barrier wall 102 is inclined in a land-ward direction, in embodiments by an angle of at least 20 degrees from vertical. In the embodiment of FIG. 1A, the barrier wall 102 is inclined at an angle of 30 degrees from vertical. When a wave breaks at a location below the barrier wall, the resulting rush of water 106 is directed upward across the front surface of the barrier wall 102, causing at least some of the water 108 to enter through the large holes 104 into an interior 114 of the sand-collecting apparatus 100 behind the barrier wall 102.

The sand-collecting apparatus 100 further comprises a rear wall 112 and, in embodiments, also one or two side walls (312 in FIG. 3C), which create a semi- or fully enclosed interior 114 within which the water that enters through the large holes forms a pool that allows entrained sand to settle. "Small" holes 116 are provided in the rear wall 112 and, in embodiments, in at least one side wall 312, so that sea water that has pooled within the interior can slowly drain out 118 of the interior 114 and return to the ocean. These "small" holes are smaller than the "large" holes 102, and are typically less than one half inch in diameter. In embodiments the small holes are included in a section of metal or plastic screen that is installed in the rear wall and/or in one or more side walls 312. In the embodiment of FIG. 1A, the small holes 116 are offset from the bottom panel 120 of the sand-collecting apparatus, so as to encourage pooling of the water before it drains through the small holes 116. In various embodiments, this offset is between two inches and one foot.

The sand-collecting apparatus 100 further includes an underlying water reservoir 110 that collects and fills with water almost immediately after the sand-collecting apparatus 100 is placed on the shore 122, thereby maintaining the sand-collecting apparatus 100 in place. The underlying reservoir 110 extends behind the rear wall 112 of the sand-collecting apparatus 100, and includes an open region 124 that is positioned to receive water as it flows out of the sand-collecting apparatus interior 141 through the small holes 116. In the embodiment of FIG. 1A, the open region 124 is separated from the remainder of the underlying water reservoir 110 by a perforated wall 128 that provides enhanced support and rigidity. In similar embodiments, the perforated wall 128 of the underlying water reservoir 110 is omitted.

Figure 2:
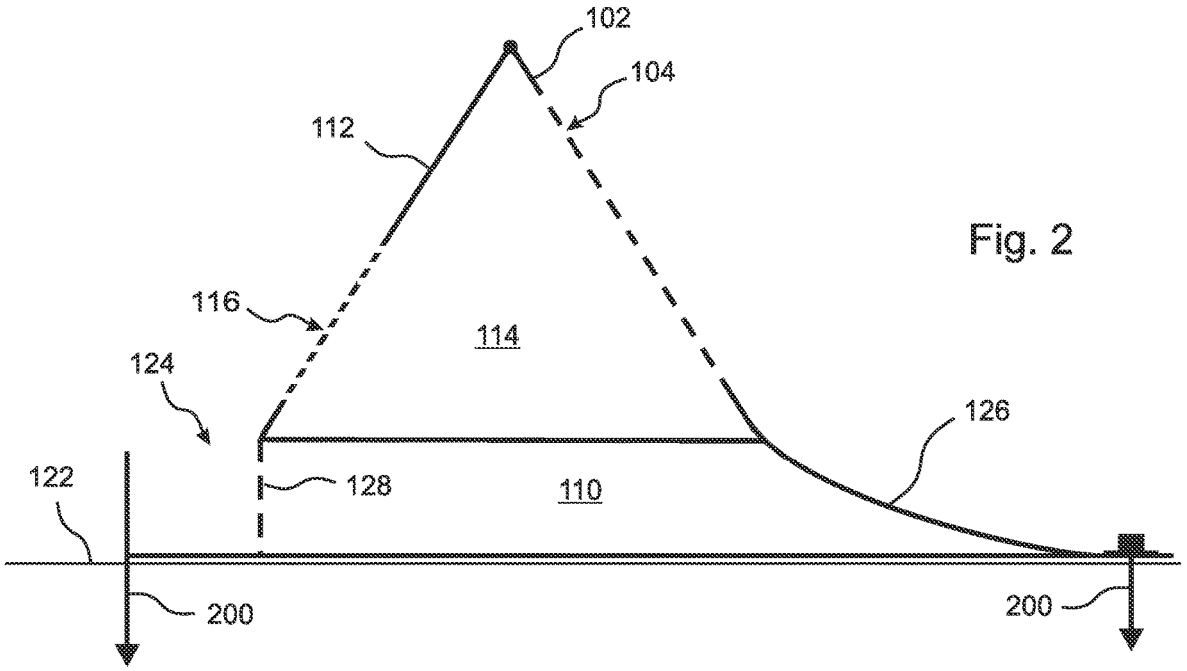
FIG. 2 is a cross-sectional view of a sand-collecting apparatus according to the present invention that is held in place by anchoring stakes and wherein the underlying water reservoir is integral with the remainder of the sand-collecting apparatus.

In the embodiment of FIG. 1A, the overlying elements of the sand-collecting apparatus 100 are attachable to and detachable from the underlying water reservoir 110. In other embodiments (see e.g. FIG. 2), the underlying water reservoir 110 is inseparable from the remainder of the sand-collecting apparatus 100.

The weight of the underlying water reservoir 110 when filled with water enables the sand-collecting apparatus 100 to be constructed from materials that are light in weight, and/or enables the sand-collecting apparatus 100 to be placed further toward the water within the tidal region, i.e. where it will encounter stronger waves, with reduced concern that the sand-collecting apparatus 100 may be displaced by the force of the waves before the weight of accumulated sand (308, FIG. 3B) within the interior 114 of the sand-collecting apparatus 100 is sufficient to hold the sand-collecting apparatus 100 in place. In the embodiment of FIG. 1A, the underlying water reservoir 110 enables the sand-collecting apparatus 100 to resist displacement by wave action without any need to use stakes or other mechanisms to anchor the sand-collecting apparatus in place. Other embodiments, such as the embodiment of FIG. 2, include an anchoring feature, such as anchor stakes 200 that can be driven into the sand 122.

Figure 1B:
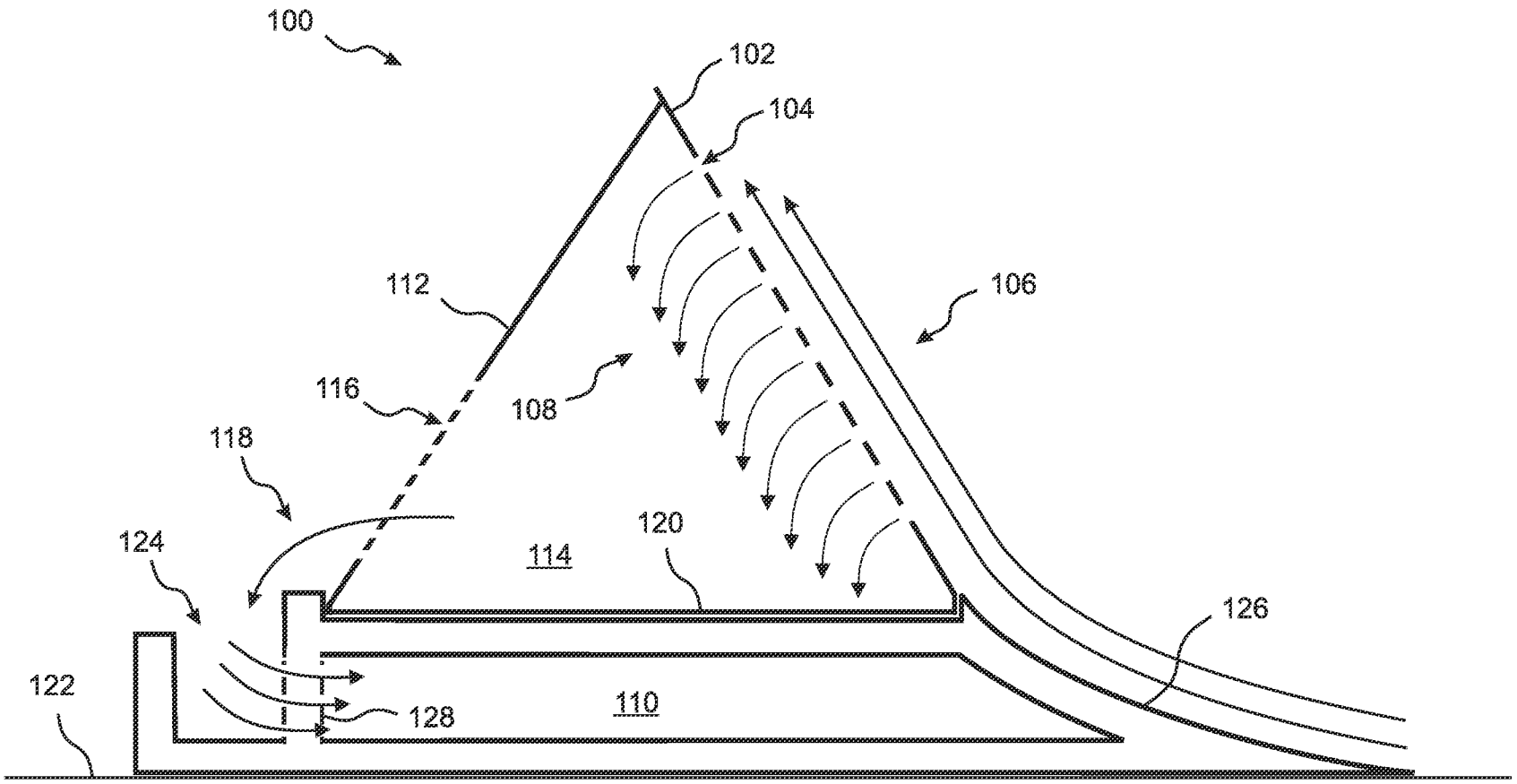
FIG. 1B is a cross-sectional view of an embodiment similar to FIG. 1B, but wherein the underlying water reservoir is configured for placement on top of the sand surface of the beach.

In the embodiment of FIG. 1A, the underlying water reservoir 110 is configured for installation below the surface 122 of the beach, so that the remainder of the sand-collecting apparatus 100 extends from the level of the sand 122 upward. In the embodiment of FIG. 1B, the underlying water reservoir 110 is configured for placement onto the sand surface 122 of the beach. The underlying water reservoir 110 in the illustrated embodiment extends in front of the barrier wall 102 and includes a curved shape 126 that guides oncoming water 106 up from the sand 122 to the large holes 104 of the barrier wall 102.

Embodiments of the disclosed sand-collecting apparatus are constructed from panels 102, 112, 120 any or all of which can range in thickness between one quarter of an inch and two inches in thickness. In some embodiments, any or all of the panels 102, 112, 120 are between one quarter of an inch and one inch in thickness. In other embodiments, any or all of the panels 102, 112, 120 are between 1/32 inch and 12 inches thick.

In various embodiments, any or all of the panels 102, 112, 120 are sheets made from plywood, from metal, from a plastic such as acrylic, from fiberglass, from particle board, which may include a laminated coating or veneer, from micro-lattice, from rigid foam, from Styrofoam, from graphene, and/or from some other suitable material. Some embodiments include a bottom panel 120, while others do not.

Figure 1C:
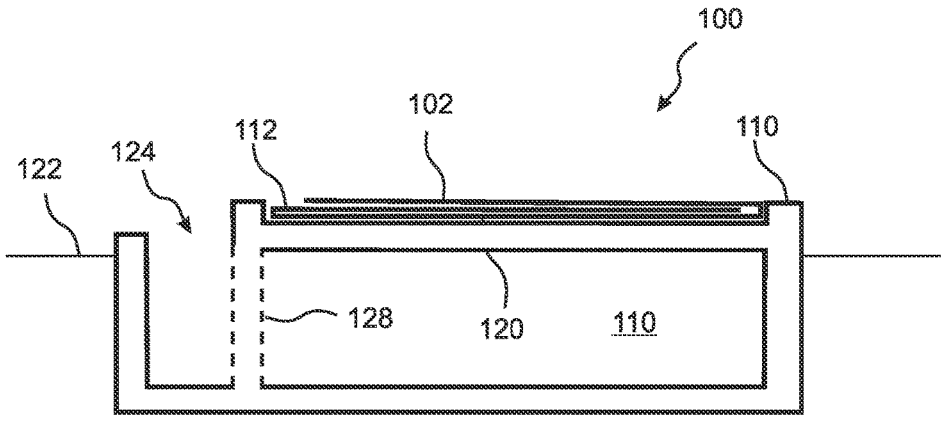
FIG. 1C is a cross-sectional view of the sand-collecting apparatus of FIG. 1A shown in a folded configuration.

Embodiments can be easily disassembled and/or folded for transport and for storage at the deployed location or elsewhere. With reference to FIG. 1C, embodiments can be folded and stored in place, and then erected when needed. In similar embodiments, the underlying water reservoir can also be folded for transport and storage.

While the disclosed sand-collecting apparatus 100 is not intended to withstand primary tidal and wave forces, it will generally be subject to winds, and to the residual energy of the water that flows up the front surface of the barrier wall 102. In the embodiments of FIGS. 1A-1C the weight of the underlying water reservoir 110, when filled with water, is sufficient to hold the sand-collecting apparatus 100 in place when subject to these forces. As an alternative, in addition to the underlying water reservoir 110, the embodiment of FIG. 2 also includes anchor stakes 200 that can be driven into the sand. This embodiment does not include a bottom panel 120. Instead, the underlying water reservoir 110 is integral with the remainder of the sand-collecting apparatus 100.

Figure 3A:
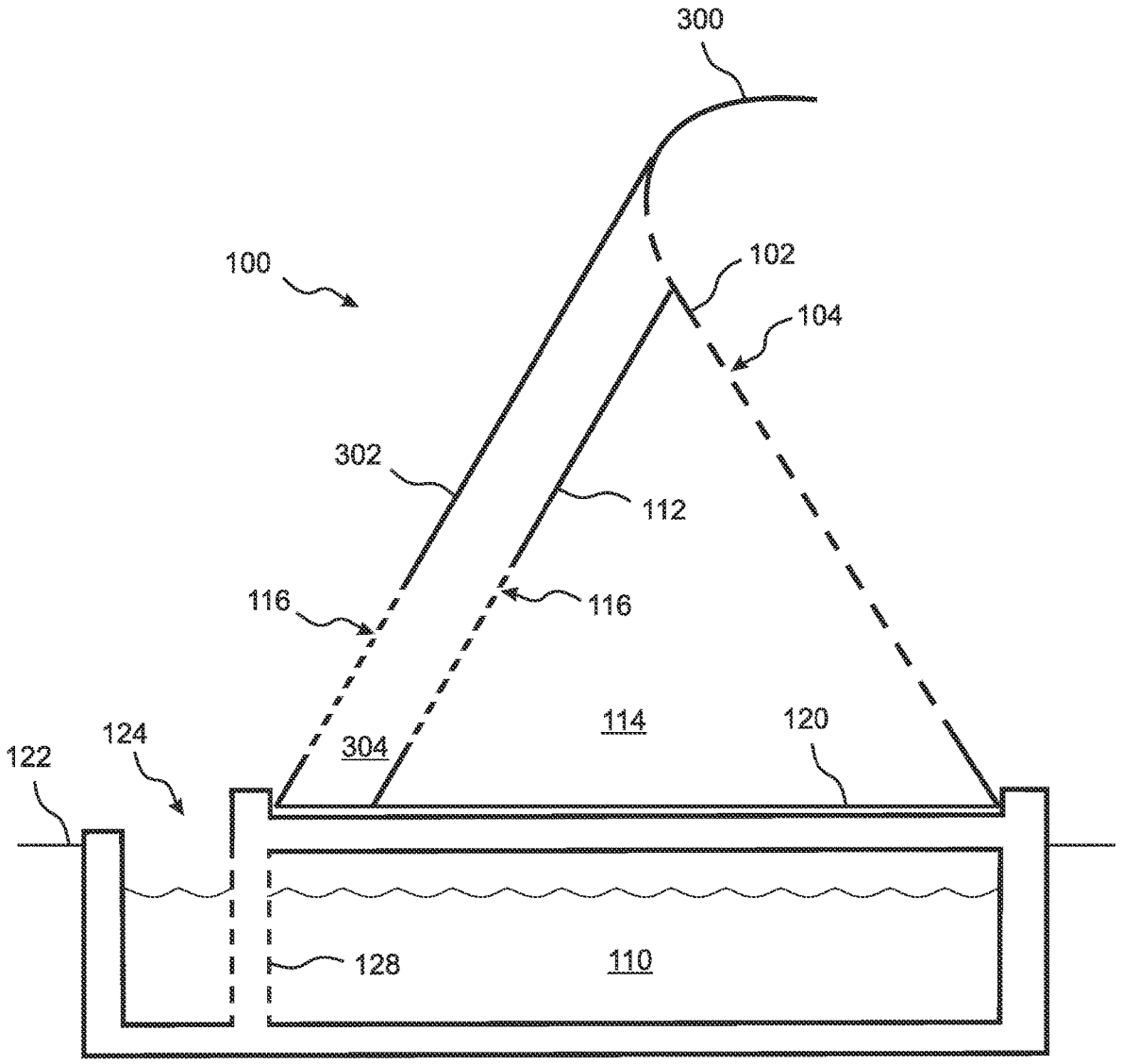
FIG. 3A is a cross-sectional view of the sand-collecting apparatus in an embodiment where the barrier wall includes a curved top extending above the rear wall, and the apparatus further includes a backstop wall.

With reference to FIG. 3A, in some embodiments the upper end 300 of the barrier wall 102 is curved seaward, so that energetically flowing water 106 that reaches the top 300 of the barrier wall 102, resulting for example from large waves generated during a storm, is directed back toward the sea and does not flow over the barrier wall 102 to the sand behind the sand-collecting apparatus. In the embodiment of FIG. 3A, the barrier wall 102 extends above the top of the rear wall 112, and a backstop wall 302 extends from behind the bottom of the rear wall 112 to a height on the barrier wall 102 that above the top of the rear wall 112, so that an additional sand-collecting chamber 304 is formed between the backstop wall 302 and the rear wall 112.

Figure 3B:
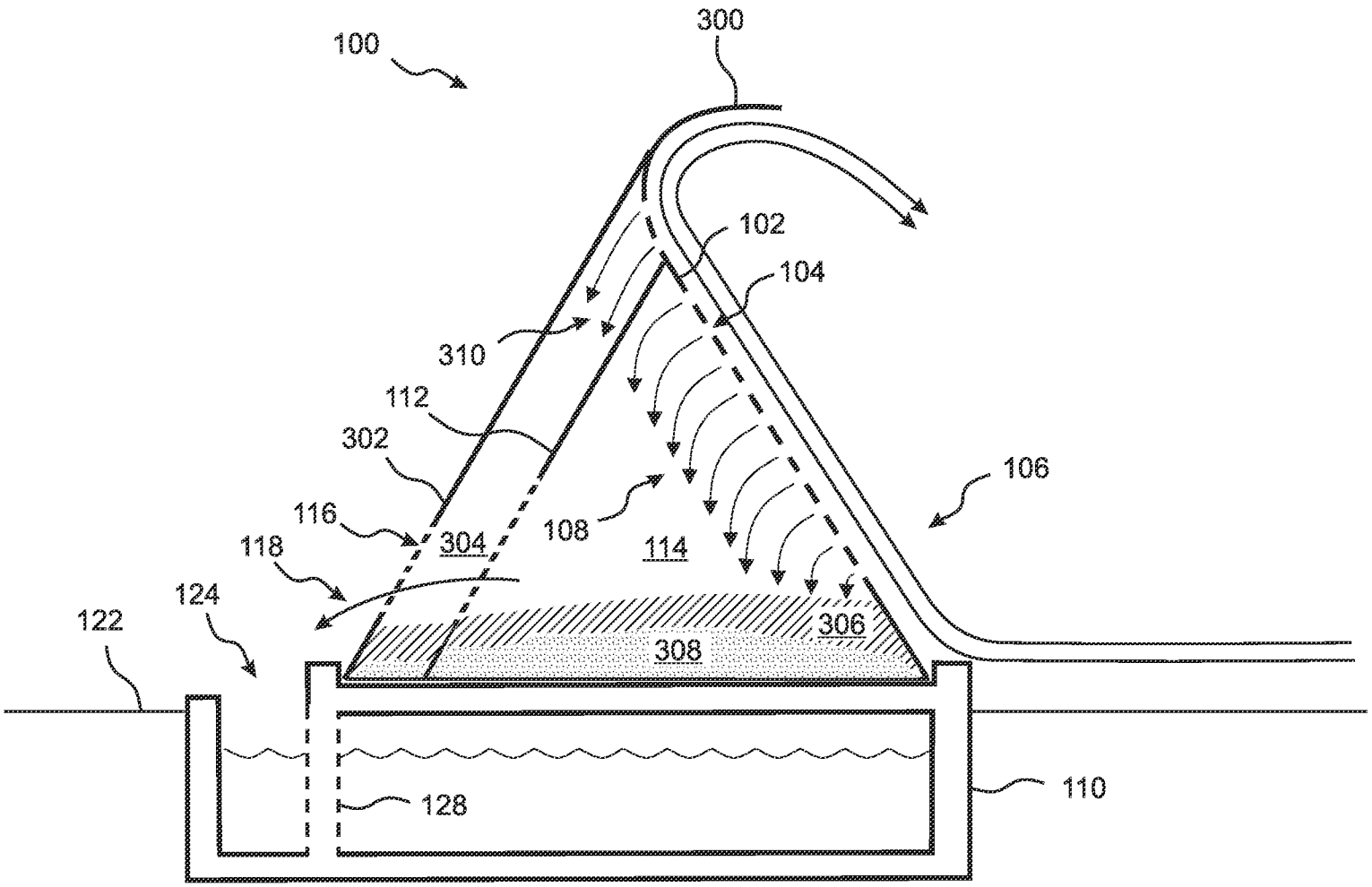
FIG. 3B is a cross-sectional view of the sand-collecting apparatus of FIG. 3A interacting with flowing water.

FIG. 3B illustrates the interaction between the sand-collecting apparatus 100 of FIG. 3A and water 106 flowing from a wave that has broken at a location seaward of the sand-collecting apparatus 100. As the water 106 flows up the front barrier 102 carrying entrained sand, some of the water 108 flows through the large holes 104 and into the interior 114 of the sand-collecting apparatus, where it forms a pool 306 that allows the entrained sand 308 to settle out of the water 306. For a strong surge of water 106, as is illustrated in FIG. 3B, some of the water 106 reaches the upper, curved portion 300 of the front barrier 102 and is directed seaward, so that it does not flow over the sand-collecting apparatus 100 and does not reach the sand behind the sand-collecting apparatus 100. Additional large holes are provided in the upper portion 300 of the front barrier 102, allowing additional water 310 to flow into an additional chamber 304 formed between the backstop wall 302 and the rear wall 112, where the water pools and allows entrained sand to settle. The pools of water then slowly drain out of the interior chambers 114, 304 through the small holes 116 provided in the rear wall 112 and backstop wall 302. If the underlying water reservoir has not already been filled, the water then flows into the open region 124 of the underlying water reservoir 110 and fills the underlying reservoir 110.

Figure 3C:
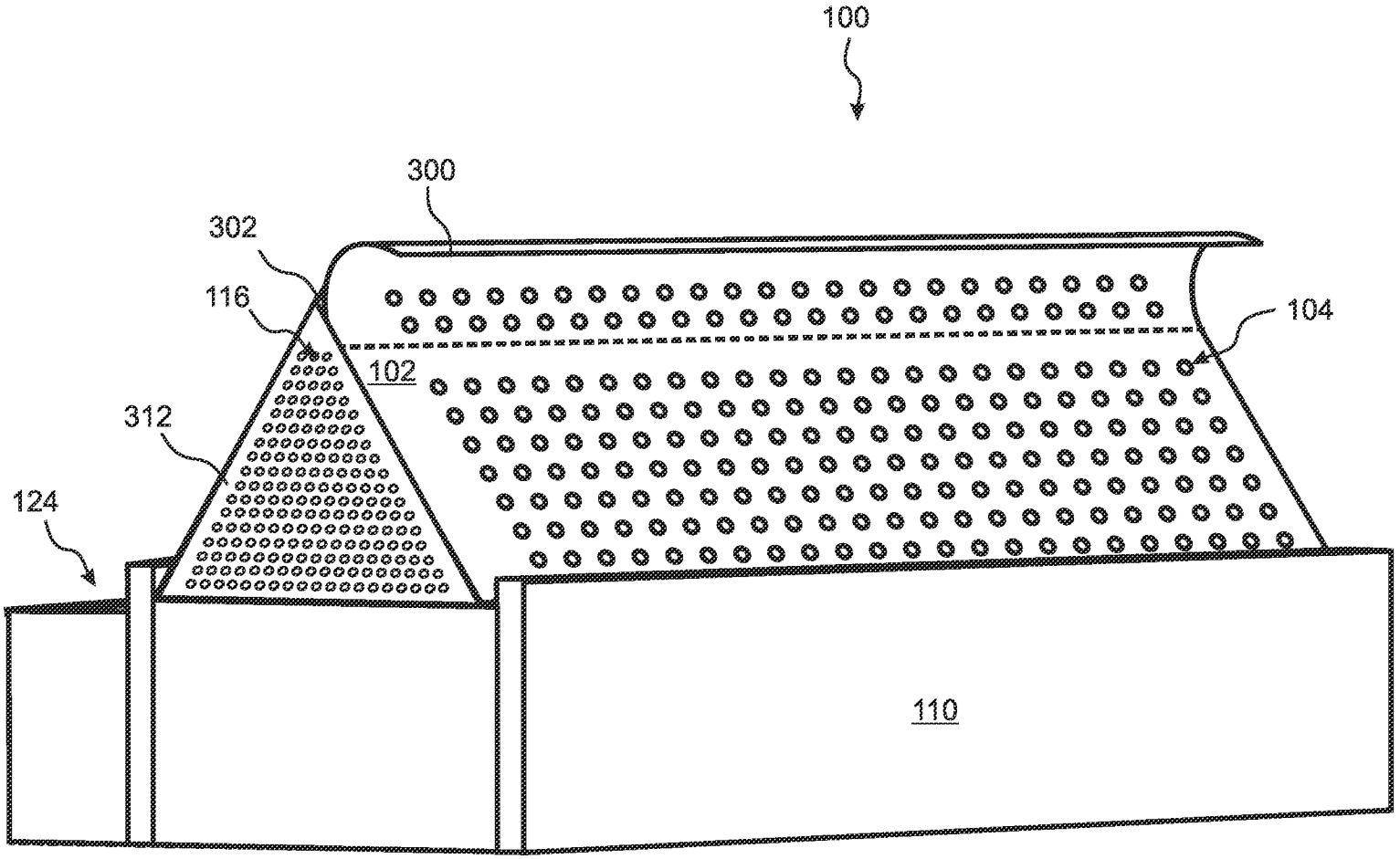
FIG. 3C is a front-left perspective view of the sand-collecting apparatus of FIG. 3A.
Figure 3D:
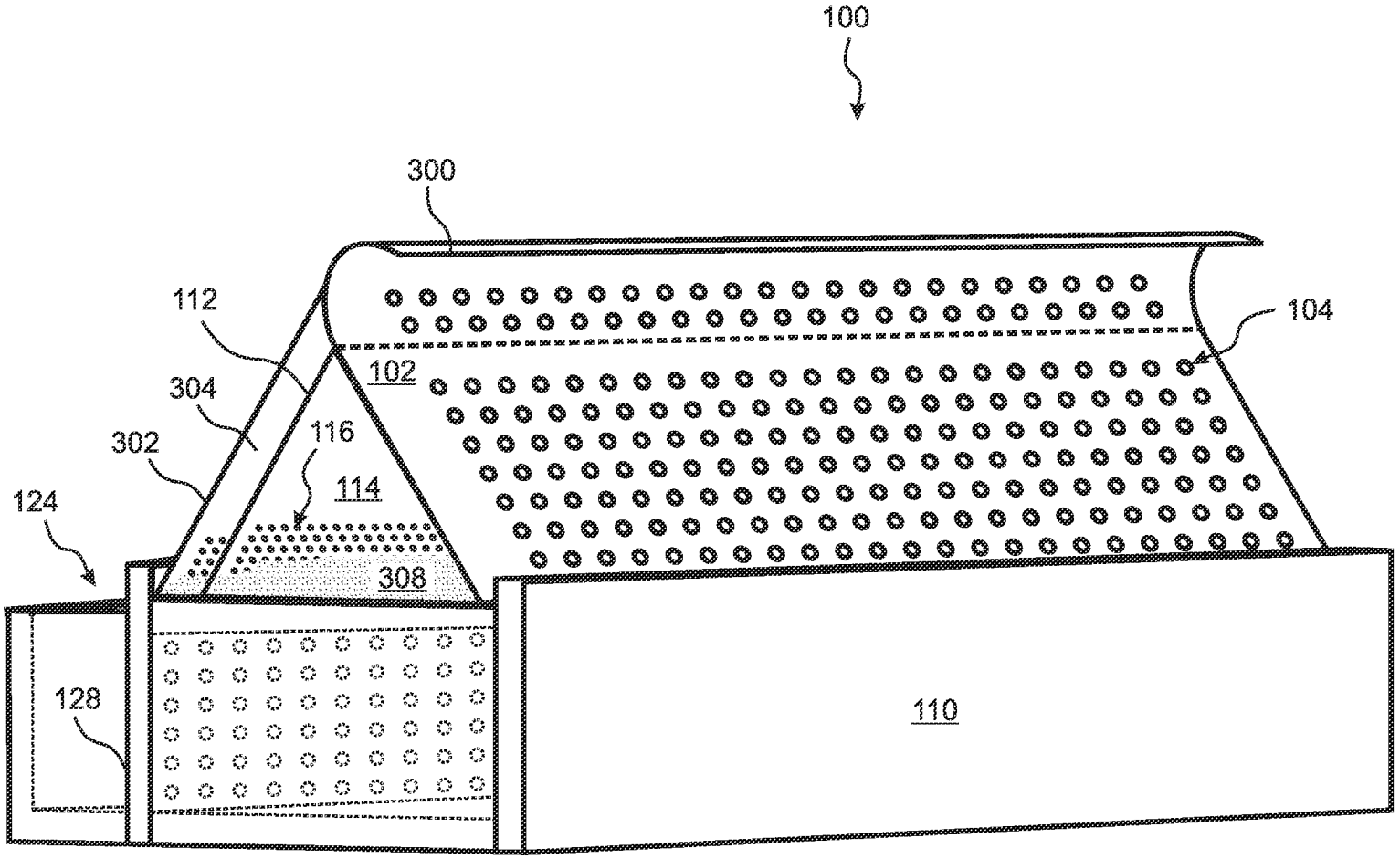
FIG. 3D is a view similar to FIG. 3C, with the left side walls rendered transparent so that interior structure can be seen.

A front-left perspective view of the embodiment of FIG. 3A is presented in FIG. 3C, and a similar view is presented in FIG. 3D, where the left side panel is made transparent so that interior structure is visible.

Figure 4:
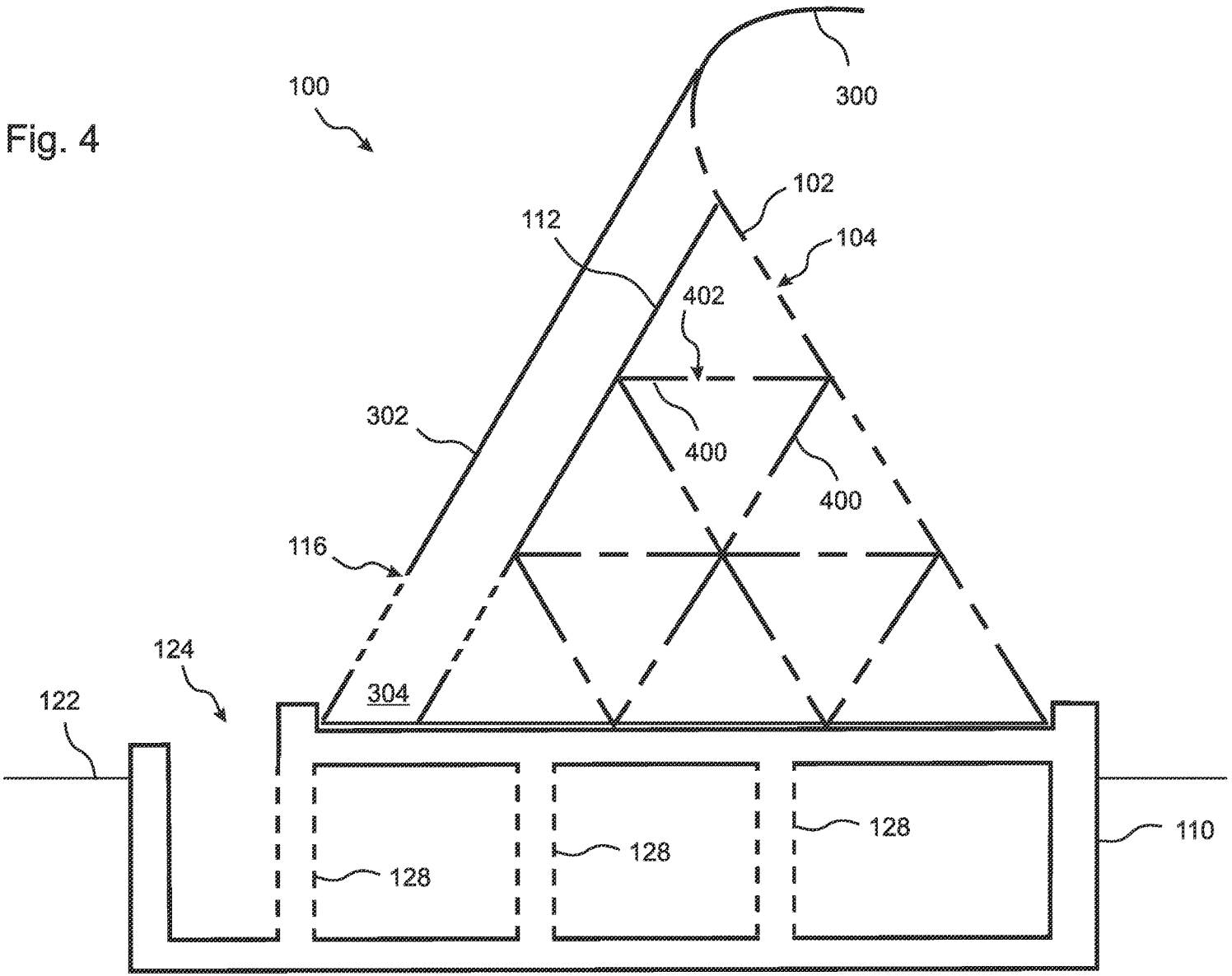
FIG. 4 is a cross-sectional view of the sand-collecting apparatus in an embodiment similar to FIG. 3A, but including structure-enhancing internal panels within its interior.

With reference to FIG. 4, some embodiments that require enhanced structural strength include internal partition walls 400 that extend between and reinforce the barrier wall 102 and rear wall 112. The partition walls 400 are penetrated by additional, interior large holes 402, so that water mixed with entrained sand that enters through the large holes 104 in the barrier wall 102 is able to flow downward through the interior large holes 402 to the bottom 120 of the sand-collecting apparatus interior 114. The embodiment of FIG. 4 also includes additional perforated walls 128 within the underlying water reservoir 110 that further enhance the structural strength.

Figure 5A:
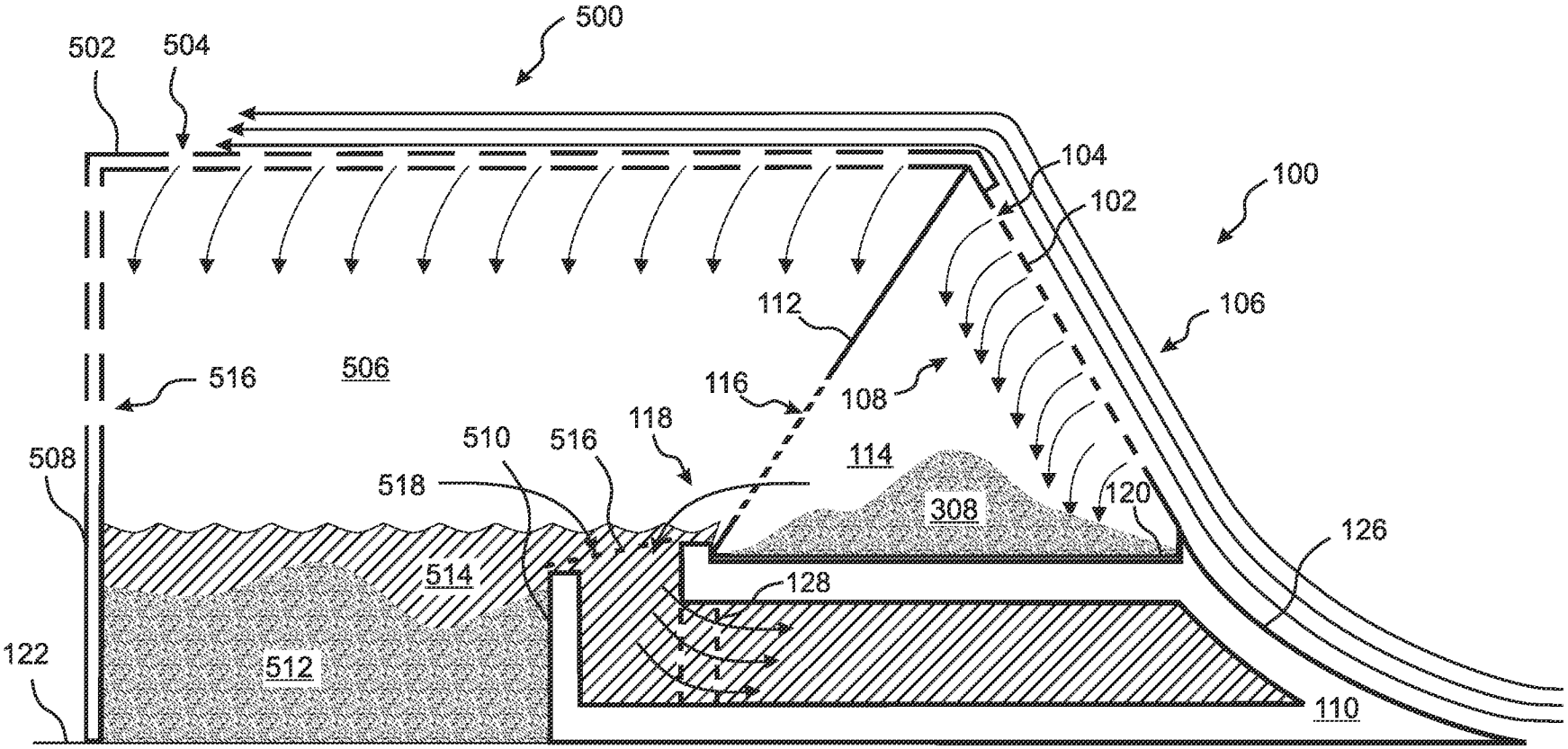
FIG. 5A is a cross-sectional illustration of a sand-collecting extension attached to a sand-collecting apparatus according to an embodiment of the present invention.

With reference to FIG. 5A, in other embodiments deflection seaward of energetically flowing water 106 that reaches the top of the barrier wall 102 is not desired, because sand that is entrained in the water 106 will also be returned to the ocean, rather than being retained on the shore. Instead, the embodiment of FIG. 5A includes a sand-collecting extension 500 that can be removably coupled to the sand-collecting apparatus 100 and underlying water reservoir 110. The sand-collecting extension 500 includes a top 502 that is penetrated by "very large" holes 504, which in embodiments are larger than the "large" holes 104 of the sand-collecting apparatus 100. When attached to the sand-collecting apparatus 100, the top 502 of the sand-collecting extension 500 extends to the upper edge of the barrier wall 102, so that energetically flowing water 106 that flows over the top of the barrier wall 102 is caused to flow across the top 502 of the sand-collecting extension 500, whereupon the water and entrained sand falls through the very large holes 504 and into an interior 506 of the sand-collecting extension 500. It will be noted that the sand-collecting extension 500 is also referred to herein simply as the "extension."

The interior 506 of the sand-collecting extension 500 in the embodiment of FIG. 5A is bounded by a rear wall 508 of the extension 500 and by two side panels (600 in FIG. 6) of the extension 500. The front of the extension 500 is open, so that the top 502 of the extension 500 can extend to the top edge of the barrier wall 102 of the sand-collecting apparatus 100. When the extension 500 is attached to the sand-collecting apparatus 100, the rear wall 510 of the underlying water reservoir 110 becomes the front boundary of the extension interior 506.

As water and entrained sand fall through the very large holes 504 into the interior 506 of the extension 500, the entrained sand 512 settles and separates from the water 514. As the level of water 514 above the sand 512 rises, the water 514 is able to flow over the rear wall 510 of the underlying reservoir 110 through a screen 518 and into the reservoir 110. In the embodiment of FIG. 5A, the rear wall 508 of the extension 500 includes additional holes 512 that allow excess water to escape from the interior 506 of the extension 500 after the reservoir 110 has been filled with water.

Figure 5B:
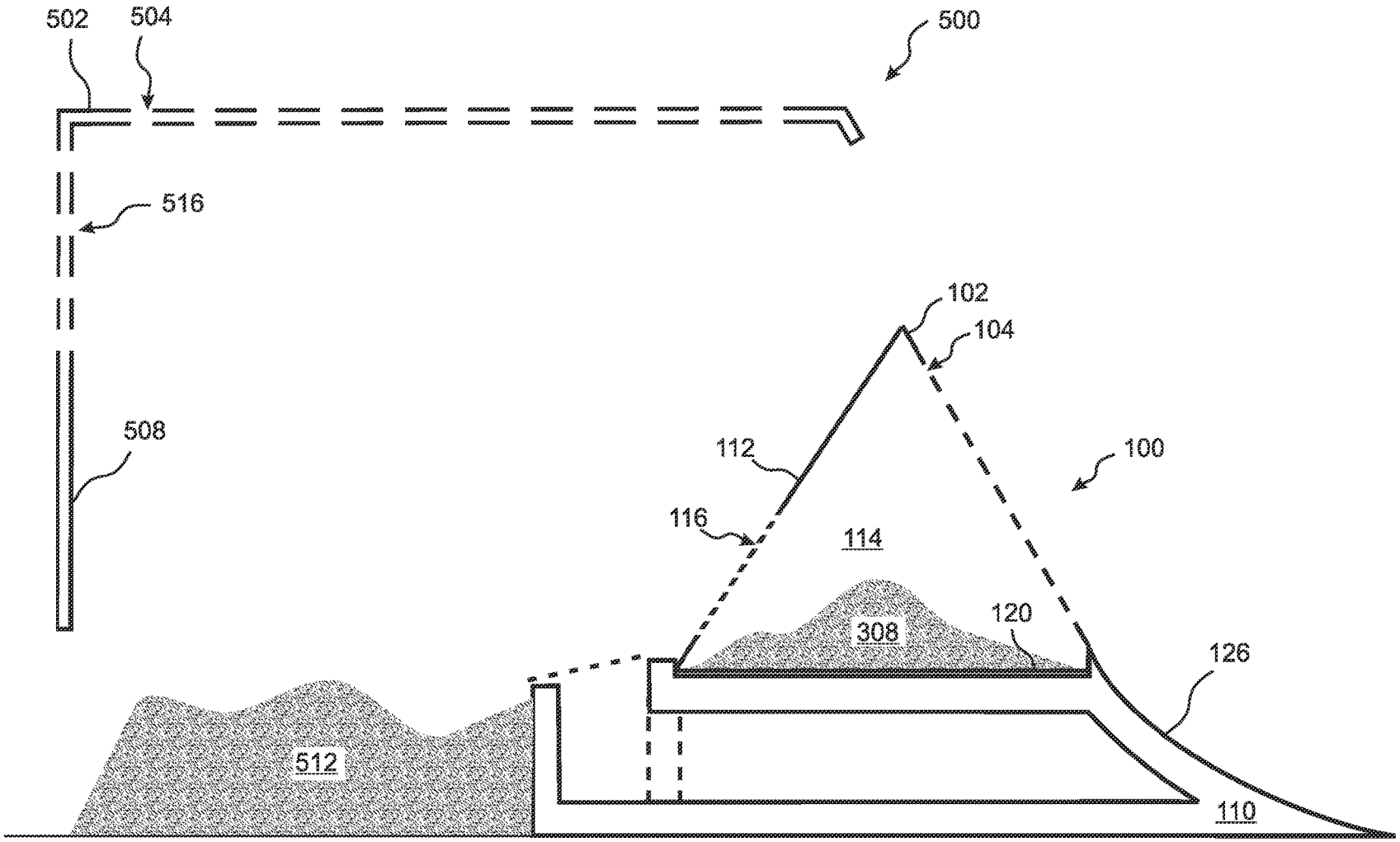
FIG. 5B is a cross-sectional illustration of the embodiment of FIG. 5A, shown with the extension removed from the sand-collecting apparatus.

In FIG. 5B, the extension 500 has been removed after a storm has ended, and is shown above and to the left of the sand-collecting apparatus 100. The sand 512 that was collected during the storm within the interior 506 of the sand-collecting extension 500 remains on the shore behind the sand-collecting apparatus 100, while additional sand 308 that was collected within the interior 114 of the sand-collecting apparatus 100 is ready for removal and distribution onto the shore.

Figure 6:
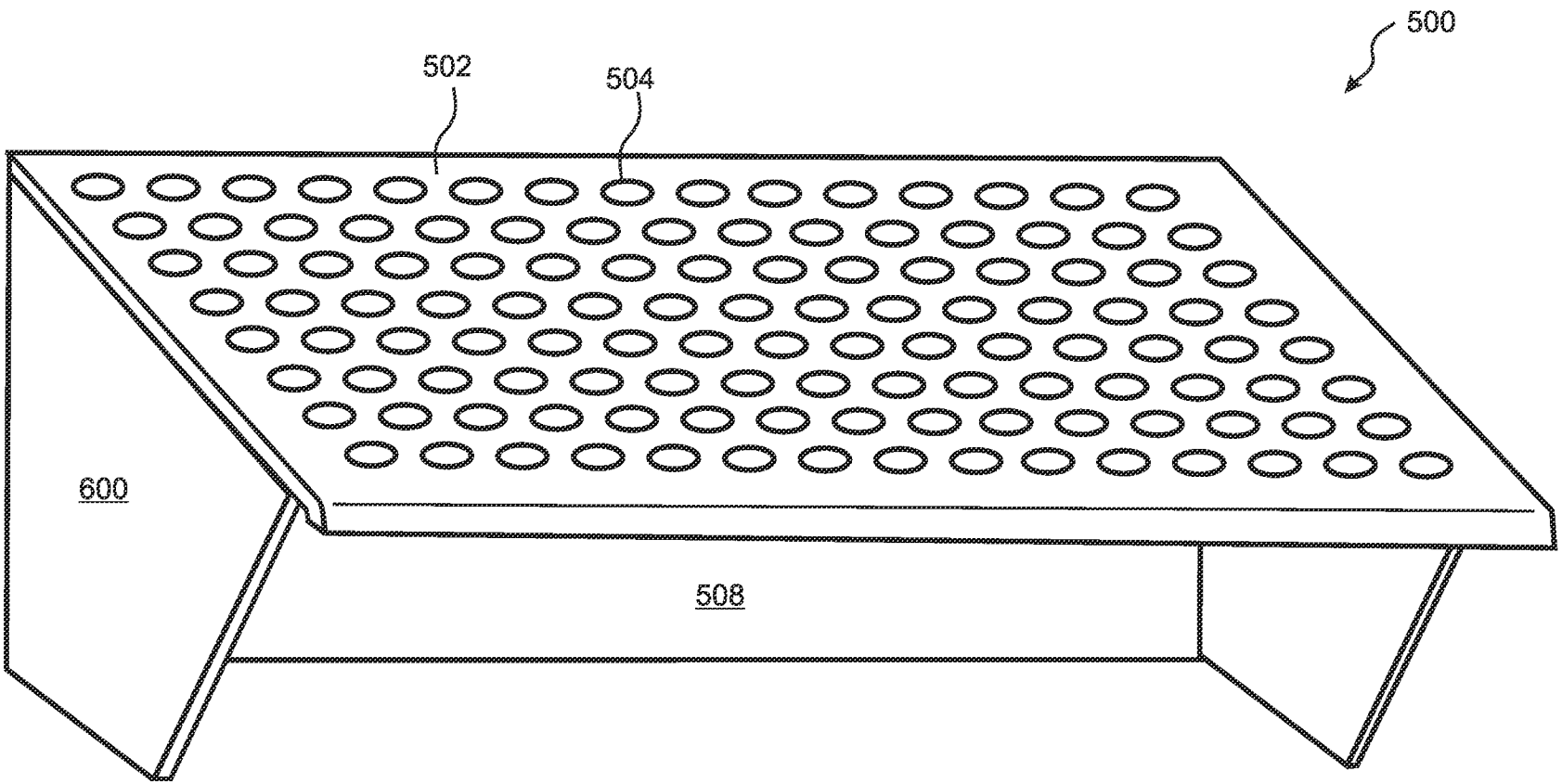
FIG. 6 is a perspective view of a sand-collecting extension in an embodiment of the invention, shown without attachment thereof to a sand-collecting apparatus.

It will be noted that FIGS. 5A and 5B are cross-sectional side views of the sand-collecting apparatus 100 and the extension 500. FIG. 6 is a perspective view from above and to the left of a sand-collecting extension 500 in an embodiment where the extension 500 includes side panels 600.

Figure 7A:
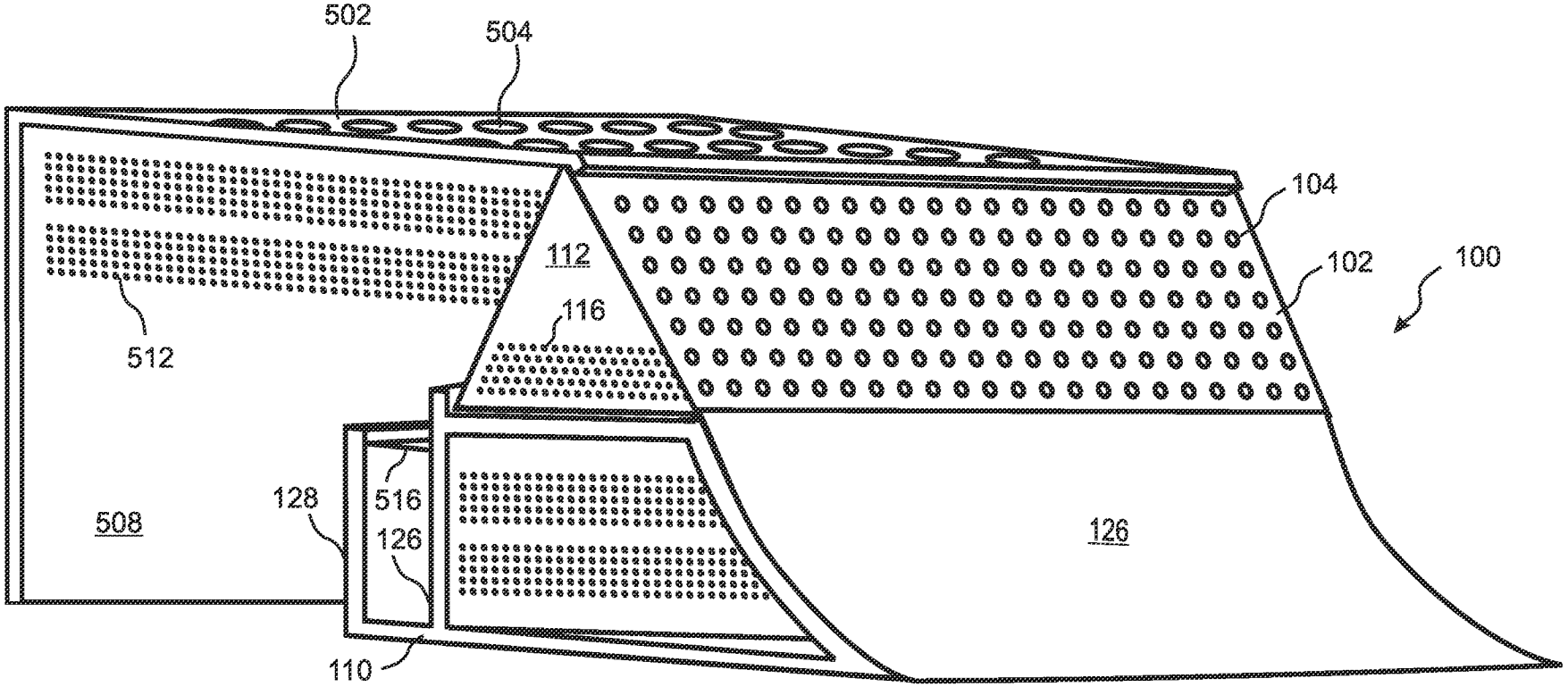
FIG. 7A is a perspective side view of the embodiment of FIG. 5A, shown with the left side panels removed so as to reveal internal structure of the embodiment.
Figure 7B:
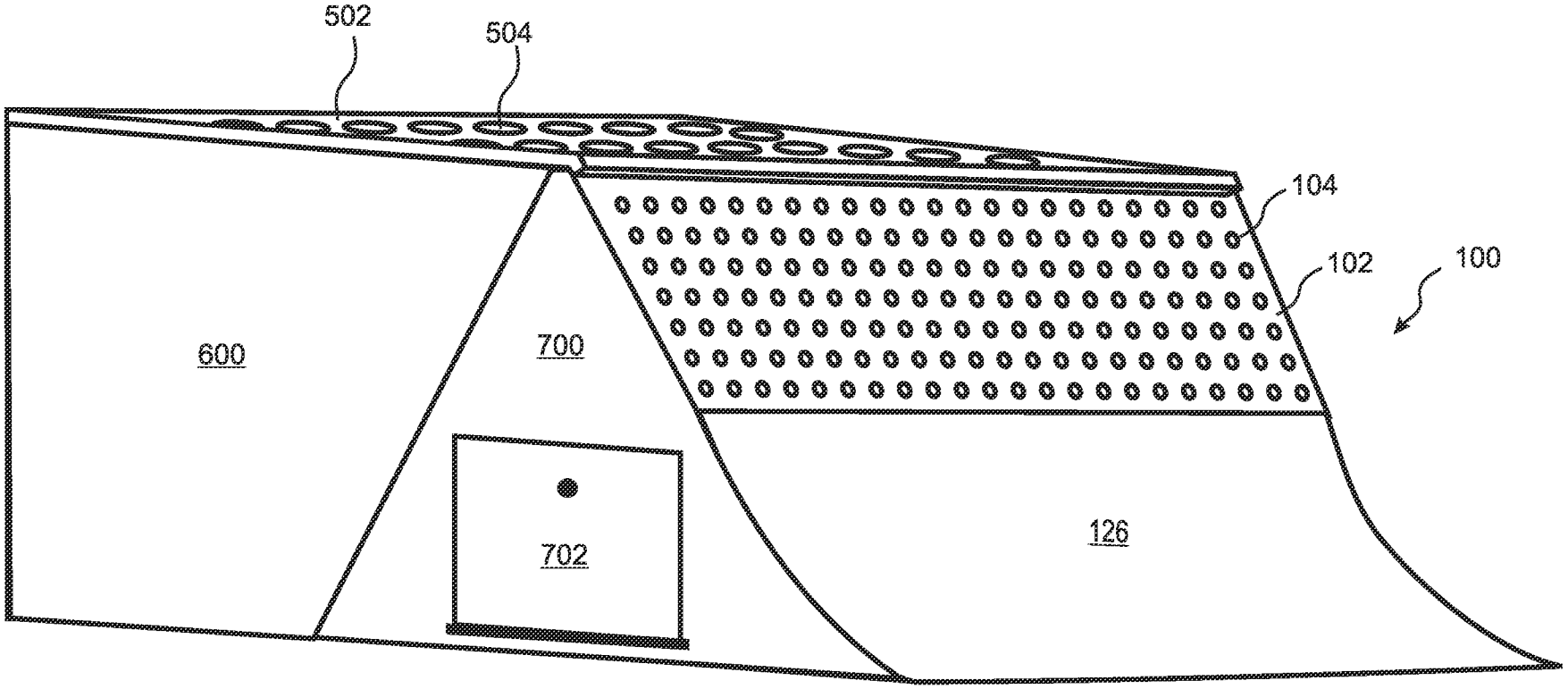
FIG. 7B is a perspective view of the embodiment of FIG. 7A, shown with the side panels included.

FIG. 7A is a perspective view from above and from the left of a sand-collecting apparatus 100 to which an extension 500 is attached. The side panels 600, 700 of the sand-collecting apparatus 100 of the extension 500 have been omitted so that internal features can be discerned. In FIG. 7B, the same view is shown, but with the side panels 600, 700 included. It will be noted that in the illustrated embodiment, the side panel 700 of the sand-collecting apparatus includes a water-releasing side door 702 that can be opened to allow retained water to escape from the underlying reservoir 110.

Figure 8:
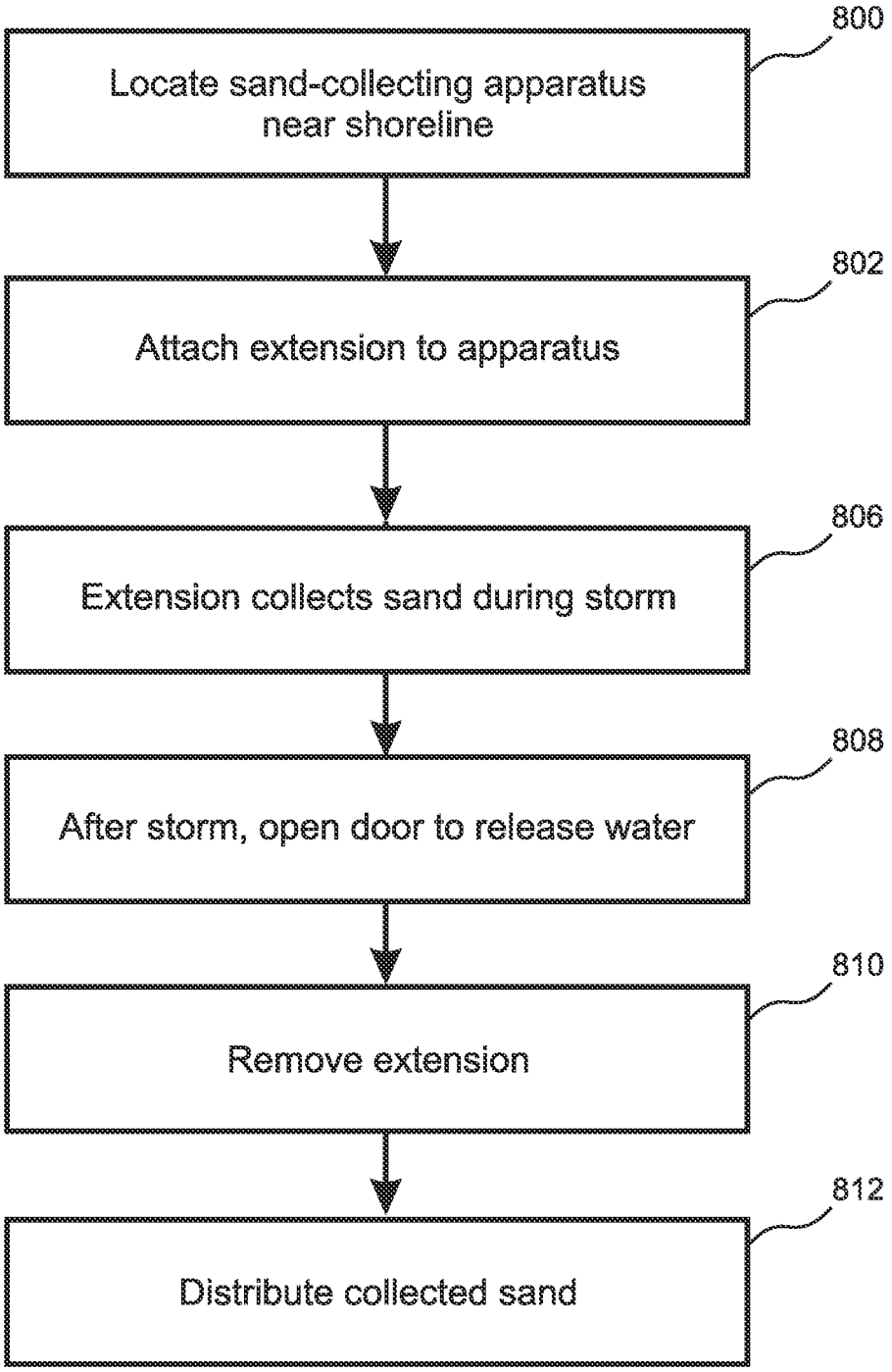
FIG. 8 is a flow diagram that illustrates a method embodiment of the present invention.

With reference to FIG. 8, according to a disclosed method of use of the sand-collecting extension 500 a sand-collecting apparatus 100 is located 800 near a shoreline above the high tide level and functions during calm weather to retain entrained sand 308 from incoming waves 106. When a storm approaches, the extension 500 is temporarily attached 802 to the sand-collecting apparatus 500 and underlying reservoir 110. During the storm, energetic water 106 together with entrained sand flows over the top of the barrier wall 102 of the sand-collecting apparatus 100 and falls through the very large holes 504 into the interior 506 of the extension 500. Excess water 514 flows into the underlying reservoir 110 until it is filled, after which additional excess water 514 flows out through the rear wall holes 516 of the extension 500. Meanwhile, sand 516 settles and collects 806 within the interior 506 of the extension 500.

After the storm has passed, the side door 702 of the sand-collecting apparatus 100, if present, can be opened 808 to allow water to escape from the underlying reservoir 110. The extension 500 is then lifted away 810 from the sand-collecting apparatus 100, leaving behind the sand 514 that was collected within the extension 500 during the storm. The newly accumulated sand 514 can simply be left in place, or it can be distributed 812 beyond the sand-collecting apparatus 100, for example using a rake.

While much of the description provided herein makes reference to "seawater" and "ocean" beaches, it should be noted that the disclosed invention is equally applicable to all sandy beaches that are exposed to wave action, including beaches adjacent to seas and large lakes.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. A system for reducing shore erosion, the system including:

a sand-collecting apparatus comprising:

a barrier wall having a top and a bottom, the barrier wall being inclined backward at an angle of at least 20 degrees from vertical;

a first plurality of holes penetrating the barrier wall;

an apparatus rear wall having a top and a bottom, the apparatus rear wall being located behind the barrier wall so that a chamber space is formed between and bounded by the barrier wall and the apparatus rear wall; and a second plurality of holes penetrating the apparatus rear wall, the holes of the second plurality of holes being smaller in diameter than the holes of the first plurality of holes, the first plurality of holes being configured to allow water to flow through the barrier wall and into the chamber space, and the second plurality of holes being configured to allow water to flow through the apparatus rear wall out of the chamber space;

an underlying water reservoir located beneath the chamber space and fixed to the barrier wall and apparatus rear wall, the underlying water reservoir being configured to receive and be filled with the water that flows through the second plurality of holes out of the chamber space; and a sand-collecting extension comprising:

an extension top penetrated by a third plurality of holes; and an extension rear wall extending downward from a rear edge of the extension top;

a front edge of the extension top being configured to abut the top of the barrier wall when the sand-collecting extension is installed behind the sand-collecting apparatus, such that water flowing over the top of the barrier wall flows across the extension top;

an interior of the sand-collecting extension being in liquid communication with the underlying reservoir.

2. The system of claim 1, wherein the sand-collecting apparatus rear wall is inclined from vertical in a forward direction, so that the top of the apparatus rear wall is in contact with a rear surface of the barrier wall.

3. The system of claim 1, wherein a thickness of the barrier wall is between ¼ inch and two inches.

4. The system of claim 1, wherein at least one of the barrier wall, the apparatus rear wall, the underlying reservoir, the extension top, and the extension rear wall is made from plywood, metal, fiberglass, particle board, micro-lattice, rigid foam, Styrofoam, graphene, and/or plastic.

5. The system of claim 1, further comprising a bottom panel extending from the bottom of the apparatus rear wall to the bottom of the barrier wall and forming a lower boundary of the chamber space.

6. The system of claim 1, wherein the chamber space is further bounded by at least one apparatus side wall.

7. The system of claim 6, wherein at least one of the apparatus side walls is penetrated by a fourth plurality of holes.

8. The system of claim 1, wherein the sand-collecting extension further comprises a pair of opposing extension side walls.

9. The system of claim 1, wherein the extension rear wall is penetrated by a fifth plurality of holes.

10. The system of claim 1, wherein the underlying reservoir further comprises a door that can be opened to release water from within the underlying reservoir.

11. The system of claim 10, wherein the door is located in a side panel of the sand-collecting apparatus or underlying reservoir.

12. The system of claim 1, wherein the holes of the second plurality of holes have diameters that are less than ¼ inch.

13. The system of claim 1, wherein the holes of the first plurality of holes have diameters that are between ¼ inch and 6 inches.

14. The system of claim 1, further comprising a plurality of anchoring stakes configured to anchor to underlying sand at least one of the underlying water reservoir, the sand-collecting extension, and the barrier wall.

15. The system of claim 1, wherein the underlying water reservoir is removably attached to the barrier wall and apparatus rear wall.

16. The system of claim 1, wherein the sand-collecting extension is removably attachable to the sand-collecting apparatus.

17. The system of claim 1, wherein the underlying water reservoir includes a curved front that is configured, when placed on a sand surface of the shore, to guide oncoming water to the barrier wall.

18. The system of claim 1, wherein the barrier wall and apparatus rear wall can be pivoted about their bottoms so as to overlap with each other in a substantially flat, folded configuration.

19. A method for reducing erosion of a sand shore that abuts a body of water, wherein the body of water generates waves that break onto the sand shore, the method comprising:

providing the system of claim 1;

installing the sand-collecting apparatus on the sand shore in an orientation wherein the barrier wall faces the body of water, the apparatus being installed at a location above a highest location where the waves break, but in a location where water emitted by the breaking waves will reach the apparatus;

before the onset of a storm, locating the sand-collecting extension behind the sand-collecting apparatus, and causing the front edge of the extension top to about the top of the barrier wall;

during the storm, as water mixed with entrained sand from breaking waves flows up the barrier wall and across the extension top, allowing the water and entrained sand to flow through the first plurality of holes into the chamber space, and through the third plurality of holes into the interior of the sand-collecting extension, while the underlying reservoir is filled by excess water that flows through at least one of the first, second, and third plurality of holes;

during the storm, allowing the entrained sand to accumulate within the chamber space and within the interior of the sand-collecting extension; and upon cessation of the storm, removing the sand-collecting extension from the sand-collecting apparatus, whereby the sand that has settled within the interior of the sand-collecting apparatus remains on the shore behind the sand-collecting apparatus.

20. The method of claim 19, further comprising relocating the sand-collecting apparatus after sand has been accumulated therein, the accumulated sand being left behind as added shore sand.

* * * * *